United States Patent [19]

Arndt

[11] Patent Number: 4,628,900

[45] Date of Patent: Dec. 16, 1986

[54] RADIANT HEATER

[76] Inventor: H. Chandler Arndt, 3000 Sharon Rd., Charlotte, N.C. 28211

[21] Appl. No.: 792,816

[22] Filed: Oct. 30, 1985

[51] Int. Cl.[4] ..... F24C 3/04

[52] U.S. Cl. ..... 126/92 AC; 431/154; 431/328; 248/233

[58] Field of Search ..... 431/328, 343, 154, 155; 126/92 R, 92 A, 92 B, 92 AC; 165/49, 56, 67; 248/232, 233, 231.8; 219/339, 342, 345

[56] References Cited

U.S. PATENT DOCUMENTS 2,665,869 1/1954 Samuels ..... 248/231.8

3,582,614 6/1971 Zellers ..... 165/49 X

*Primary Examiner*—Margaret A. Focarino

*Attorney, Agent, or Firm*—Shefte, Pinckney & Sawyer

[57] ABSTRACT

Radiant burners are provided with a pair of opposed mounting legs for ready installation and removal from a support structure having a pair of spaced parallel support rails without utilizing bolts, other fasteners, or special tools. One leg has a C-shaped engagement portion adapted to hookingly engage about and receive one support rail, while the other leg includes an L-shaped engagement portion with detents at the free end thereof to resiliently engage the other rail by a snap fit.

5 Claims, 6 Drawing Figures

RADIANT HEATER

BACKGROUND OF THE INVENTION

The present invention relates generally to radiant gas heaters or burners of the type having a refractory burner face and more particularly to arrangements for mounting such heaters in operating disposition.

Such radiant heaters basically utilize a refractory burner face in a panel, tile or mat form fitted in the open mouth of a burner housing which defines a plenum for containing and supplying a combustible gas and air mixture to the face. In operation, the combustion mixture is continuously passed through the face and burns at the outward surface thereof, normally in the form of a very small flame which covers the entire face and which reaches rather high temperatures to produce a continuous radiant heat surface over the entire exposed area of the face. Representative examples of such heaters are disclosed in U.S. Pat. Nos. 3,191,659; 3,407,023; 3,407,024; 4,189,297; 4,255,123; 4,272,237; 4,272,238; 4,413,976; and 4,416,618.

Conventionally, such radiant heaters are put to a diverse variety of uses. One typical use of these heaters is to dry moving webs of textile fabric following various wet treatment operations thereon. Typically, such heaters are made in relatively small rectangular shapes to facilitate selective mounting of a plurality of the heaters in assembly with their respective burner faces contiguous to provide an effectively continuous heater surface of the dimension required for a given use of the heaters. These heaters are ordinarily provided with mounting legs which simply are bolted rigidly in place to a support structure in an assembly installation, which disadvantageously requires a considerable amount of down time in the operation of the heater assembly whenever it is necessary to remove and repair or replace a malfunctioning or damaged heater. Most of the development work in this industry has been devoted to improving the design of the heater structure itself to reduce the incidence of heater malfunction, as is illustrated by the above-listed patents, and there therefore exists a need for a better system of mounting such heaters to facilitate easy removal and replacement when such becomes necessary.

It is accordingly an object of the present invention to provide an improved mounting arrangement for radiant heaters of the relevant type which enables them to be releasably mounted in operative disposition for rapid and secure installation and removal without the use of bolts or other fasteners and without requiring special tools, thereby to minimize heater down time when repair or replacement of heaters is required.

SUMMARY OF THE INVENTION

The mounting arrangement of the present invention is particularly adapted and intended for use with a gas-fired radiant heater of the above-described type having a housing with an open mouth and a burner face fitted therein to define a plenum for containing and supplying a combustion gas to the face. Briefly described, the mounting arrangement includes a pair of mounting legs affixed to the housing to extend therefrom in opposed facing relation to one another, one of the legs being adapted to engage about one side of a support structure and the other leg being adapted to resiliently engage the opposite side of the support structure to releasably retain the mounting legs in frictional engagement with the support structure. In this manner, the heater may be readily installed on and removed from the support structure rapidly and without the use of fasteners or tools.

In the preferred embodiment, the first mounting leg includes a generally C-shaped engagement portion adapted to hookingly engage about the corresponding side of the support structure, while the other leg includes a resilient generally L-shaped engagement portion having detents formed at the free end thereof to engage resiliently about the other corresponding side of the support structure. The support structure preferably includes a pair of longitudinal mounting rails extending in generally parallel spaced relation to one another with each rail having a retaining edge portion. The C-shaped engagement portion of the first rail is adapted to receive therewithin the corresponding rail of the support structure to hookingly engage the retaining edge portion of such rail, while the L-shaped engagement portion of the other leg is adapted to resiliently engage the other corresponding rail with the detents of such leg engaging the retaining edge portion of such rail by a resilient snap fit therewith.

DESCRIPTION OF THE PREFERRED EMBODIMENT

Figure 1:
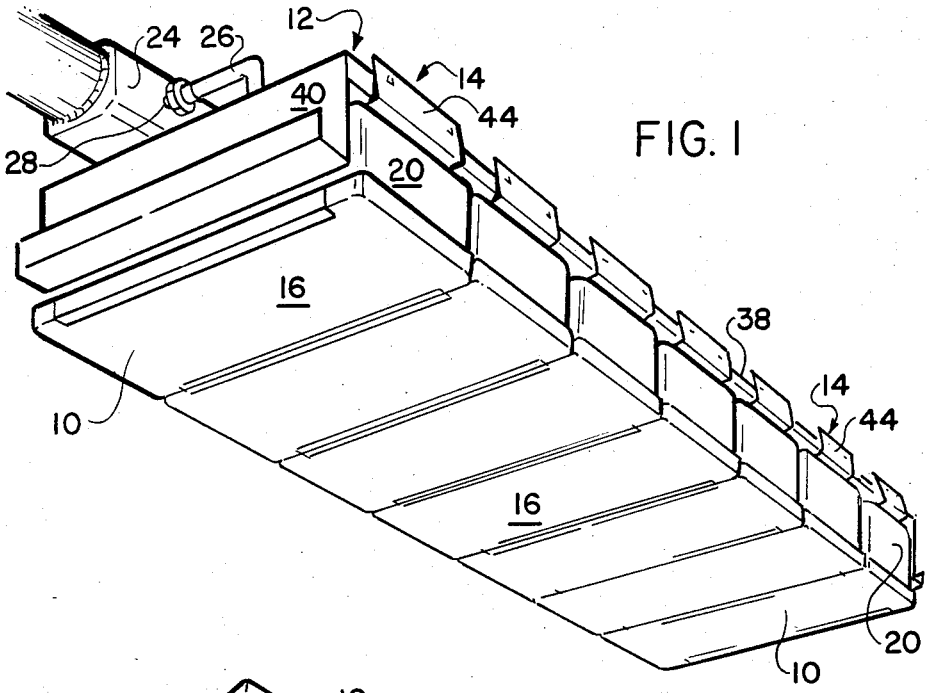
FIG. 1 is a bottom perspective view of a bank of radiant heaters mounted in operative disposition by the preferred embodiment of the mounting arrangement of the present invention.
Figure 2:
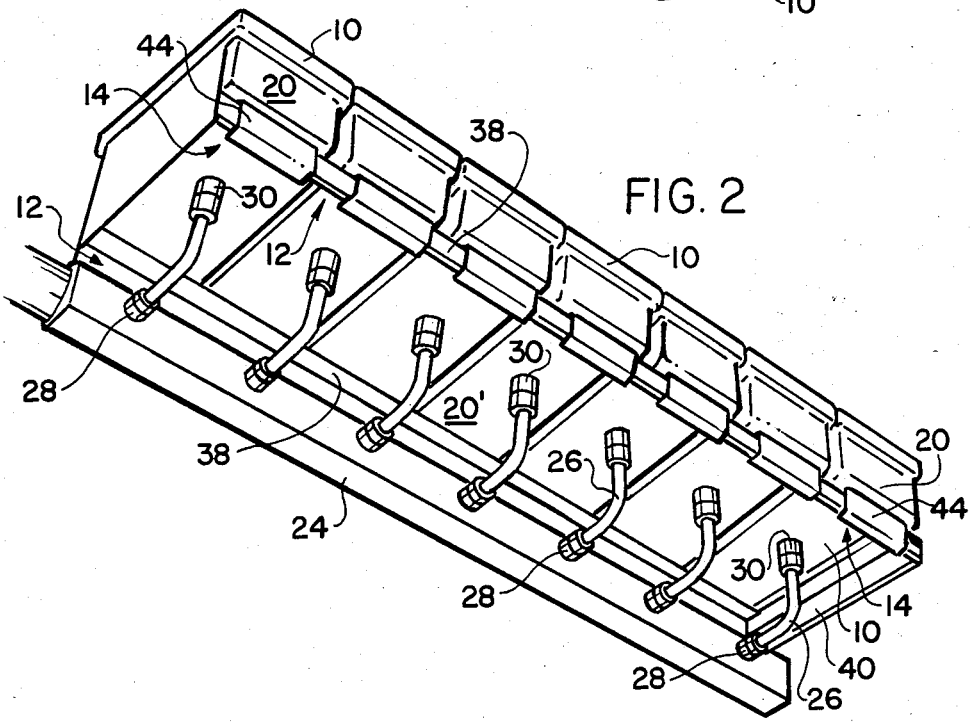
FIG. 2 is a top perspective view thereof.

Referring now to the accompanying drawings and initially to FIGS. 1 and 2, a bank of several radiant heaters 10 are illustrated in mounted operating disposition on a support structure, indicated generally at 12, by the mounting arrangement of the present invention, indicated generally at 14.

Figure 3:
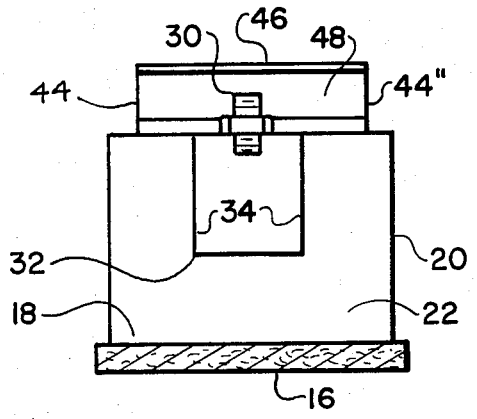
FIG. 3 is a vertical cross-sectional view taken widthwise through one radiant heater incorporating the mounting legs of the preferred embodiment of the mounting arrangement of the present invention.
Figure 4:
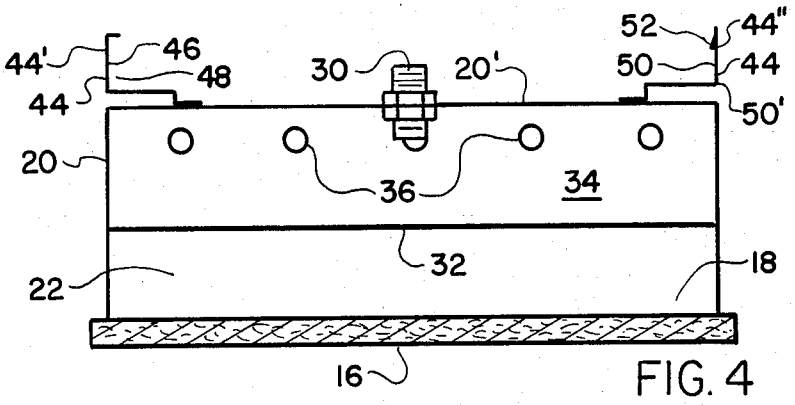
FIG. 4 is a vertical cross-sectional view taken lengthwise through the radiant heater of FIG. 3.

Each heater 10 basically includes a porous refractory tile 16 forming a burner face fitted in the open mouth 18 of a box-like metal housing 20. The housing 20 and the tile face 16 of each heater 10 define therewithin a plenum 22 (FIGS. 3 and 4) to contain and supply a mixture of combustible gas and air to the tile face 16. A longitudinal tubular manifold 24 is mounted to the support structure 12 along one lengthwise side thereof in communication with a supply (not shown) of the desired combustible air and gas mixture and provides a continuous supply of the mixture to the several radiant heaters 10 through a corresponding number of respective individual supply conduits 26 which extend between tubular nipple connectors 28 fitted through the adjacent wall of the manifold 24 at spacings along the length thereof and corresponding nipple connectors 30 fitted in the housing walls 20' of the heaters 10 opposite their faces 16.

In basic operation, the combustible gas and air mixture disperses from each nipple connector 30 throughout the plenum 22 of the respective heater 10 and passes through its tile face 16 to the outward surface of the face 16 at which the mixture burns. A blower or the like (not shown) associated with the manifold 24 provides sufficient gas pressure within the manifold 24, the conduits 26 and the plenums 22 to insure continuous flow of the mixture to the burning surface of each tile 16.

Each heater 10 is provided internally of its housing 20 with a baffle member 32 which is of a U-shape and extends the length of the plenum 22 to enclose the interior end of the respective nipple connector 30 to initially contain the gas and air mixture entering the plenum 22. The oppposite side walls 34 of the baffle 32 are provided with a plurality of individual openings 36 through which the mixture passes into the main area of the plenum 22 to reach the tile face 16. In this manner, the baffle member 32 effectively disperses the entering combustible mixture throughout the plenum 22 to provide a generally uniform supply of the mixture over the entire area of the tile face 16 to enhance the evenness of the burning of the gas at the outward burning surface of the tile 16.

The support structure 12 basically includes a pair of longitudinal side rails 38 affixed in spaced parallel relation to one another by periodically spaced cross member 40 extending transversely between and affixed to the side rails 38. Each side rail 38 provides a generally flat retaining edge portion 42 along the surface thereof facing away from the side of the support structure 12 to which the heaters 10 are to be mounted. Preferably, a plain flat metal place or bar of rectangular cross section is utilized for each side rail 38. The side rails 38 are spaced apart by the cross members 40 a distance approximately equal to the lengthwise dimension of each heater housing 20.

The mounting arrangement 14 of the present invention provides a pair of mounting legs or clips 44 affixed in opposed facing relation to one another to each housing 20 to extend outwardly from the housing wall 20' of each heater 10 opposite the tile face 16. One leg 44' of each pair of the legs 44 includes a generally C-shaped engagement portion 46 which defines therewithin a receiving area 48 opening inwardly toward the other leg 44". The C-shaped engagement portion 46 is configured to receive one of the rails 38 within the defined receiving area 48 by a relatively snug fit, to facilitate mounting installation as hereinafter described. The other leg 44" of each pair of legs 44 includes a generally L-shaped engagement portion 50 oriented with the free end thereof extending in generally normal facing relation to the C-shaped portion 46 of the corresponding leg 44'. A pair of detents 52 are formed at the free end of the L-shaped engagement portion 50 to project inwardly in the direction toward the corresponding leg 44'. The L-shaped portion 50 defines a slightly acute angle at the corner 50' thereof with the dimension between the corner 50' and the detents 52 substantially corresponding to the vertical dimension of the outward side of each rail 38 to provide a snag-type resilient frictional engagement of the L-shaped portion 50 with the corresponding rail 38 upon mounting installation as hereinafter described. The distance between the facing surfaces of the C-shaped portion 46 and the L-shaped portion 50 of each pair of legs 44 is slightly less than the transverse distance between the respective outwardly facing side surfaces of the rails 38 of the support structure 12.

Figure 5:
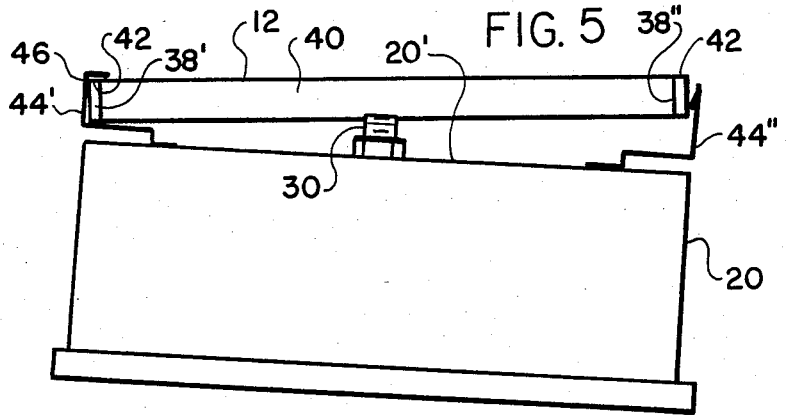
FIG. 5 is an elevational view showing the radiant heater of FIGS. 3 and 4 in the process of mounting installation as seen from the end of the heater support structure used for the bank of radiant heaters in FIGS. 1 and 2.
Figure 6:
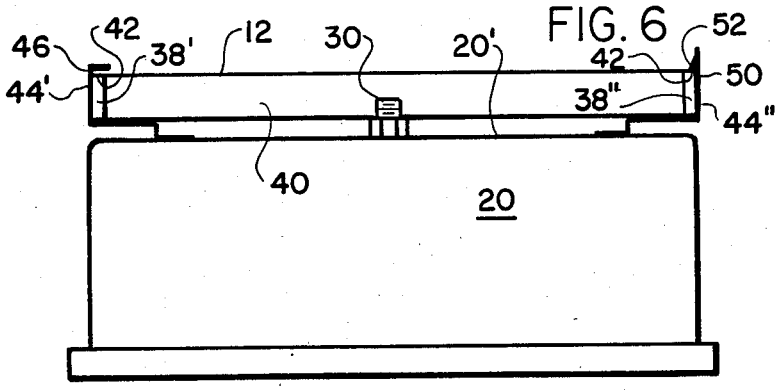
FIG. 6 is an elevational view similar to FIG. 5 showing the radiant heater thereof in its final mounted disposition.

With reference now to FIGS. 5 and 6, the process of mounting the heaters 10 on and removing them from the support structure 12 will be understood. To install each heater 10 on the support structure 12, the C-shaped portion 46 of the leg 44' of the heater 10 is initially hookingly engaged about the retaining edge portion 42 of one of the rails 38' at a selected desired location along the support structure 12 to position the rail 38' within the receiving area 48 of the C-shaped engaging portion 46, as illustrated in FIG. 5. The L-shaped engaging portion 50 of the other leg 44" is then flexed outwardly in the direction away from the leg 44' to enable the free extending end of the L-shaped portion 50 and the detents 52 thereof to pass outwardly of the outward side surface of the other side rail 38", as also illustrated in FIG. 5. The heater 10 is then pushed toward the support structure 12 until the detents 52 of the L-shaped engaging portion 50 clear the rail 38", permitting the flexure in the L-shaped portion 50 to resiliently release to engage the detents 52 with the retaining edge portion 42 of the rail 38" and to snugly engage the rail 38" between the corner 50' of the L-shaped portion 50 and the detents 52. By virtue of the aforementioned slightly lesser distance between the facing surfaces of the C-shaped portion 46 of the leg 44' and the L-shaped portion 50 of the leg 44" than between the outward side surfaces of the side rails 38, the full amount of flexure of the L-shaped portion 50 is not released, whereby the legs 44',44" maintain a resilient snug frictional engagement with the rails 38'38", respectively, to snugly retain the heater 10 on the support structure 12. The several heaters 10 are individually installed in this manner side-by-side along the support structure 12 to provide the assembled bank of heaters 10 shown in FIGS. 1 and 2. To remove any one of the heaters 10 from the support structure 12 such as may be necessitated for repair or replacement of a given heater 10, the installation process is essentially reversed by flexing the L-shaped portion 50 of the leg 44" of the heater 10 to be demounted sufficiently to permit the detents 52 to pass outwardly of the rail 38" so that the leg 44" may be disengaged from the rail 38", following which the C-shaped portion 46 of the corresponding leg 44' may be unhooked from the rail 38'.

As will therefore be readily recognized, the mounting arrangement 14 of the mounting legs 44 on each heater 10 according to the present invention enables each heater 10 to be securely installed on the support structure 12 and to be readily demounted and removed therefrom when necessary or desirable, all without the use of bolts, screws or other fasteners and without the need for any special tools. Advantageously, the demounting of a given heater 10 and the installation of a replacement heater 10 may be readily accomplished in this manner in a matter of only a few minutes, thereby greatly minimizing down time in the operation of a bank of the present heaters 10 when repair or replacement of any thereof is necessary. Furthermore, in contrast to conventional heater mounting arrangements utilizing bolts or other fasteners, the heaters 10 of the present invention may be selectively mounted at varying locations and spacings from each other along the length of the support structure 12. The mounting legs 44 of the present mounting arrangement additionally provide a substantially snug and rigid connection of the heaters 10 to the support structure which, in many cases, is superior to conventional bolted mountings of radiant heaters wherein some degree of looseness or so-called "play" sometimes occurs in the bolted connection of the heater to the support structure producing misalignment of the respective burner faces of several assembled heaters. In contrast, the present mounting legs 44 automatically correctly orient the several burner surfaces of the tiles 16 of the heaters 10 in a heater bank squarely in proper alignment with one another. The absence of fasteners in the present mounting arrangement also permits uninhibited thermal expansion of the housing 20 of each heater 10 under effect of the significant amount of heat generated by such heaters, in contrast to conventional bolted heater mounting arrangements which restrict the ability of the heater housings to expand in a normal and natural fashion thereby sometimes producing problems of warping and misalignment of heaters.

As will be understood, the described mounting arrangement of the present invention may be readily adapted for mounting virtually any conventional raidant heater in desired operative disposition on an appropriate support structure. The particular structure of the heaters 10 herein described is exemplary and is provided solely for sake of illustration and is not intended to limit the scope of the present invention. For example, it is contemplated that some applications of radiant burners of the present type may call for the arrangement of the burner housings in end-to-end orientation, rather than the side-to-side arrangement as shown in FIGS. 1 and 2. In such arrangement, each housing may be provided with a pair of C-shaped legs 44' at spacings along one lengthwise side of the housing wall 20' and at least one of the L-shaped legs 44'' at the other lengthwise side of the housing wall 20' to insure stable alignment of the burner faces 16 in the heater bank.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A gas-fired radiant heater comprising a housing having an open mouth, a burner face fitted in said open mouth of said housing, said housing and said face defining a plenum for containing and supplying a combustion gas to said face for passage therethrough to burn on the outwardly-facing surface thereof, and means for mounting said housing to support a structure having a pair of mounting rails extending in generally parallel spaced relation to one another with each said rail having a retaining edge portion, said mounting means including a pair of mounting legs extending from said housing in opposed facing relation to one another, one said leg having a hook portion adapted to hookingly engage said retaining edge portion of one said rail of said support structure and the other said leg including detent means formed adjacent the extending end thereof adapted to resiliently engage about said retaining edge portion of the other said rail of said support structure to releasably retain said mounting legs in frictional engagement with said support structure, whereby said heater may be readily installed on and removed from said support structure rapidly and without use of fasteners or tools.

2. A gas-fired radiant heater according to claim 1 and characterized further in that said one leg includes a generally C-shaped engagement portion adapted to receive one rail therewithin to hookingly engage said retaining edge portion of said one rail.

3. A gas-fired radiant heater according to claim 1 and characterized further in that said other leg includes a generally L-shaped engagement portion having said detent means at the free end thereof to engage said retaining edge portion of said other rail by a resilient snap fit therewith.

4. A gas-fired radiant heater according to claim 2 and characterized further in that said other leg includes a generally L-shaped engagement portion having said detent means at the free end thereof to engage said retaining edge portion of said other rail by a resilient snap fit therewith.

5. A gas-fired radiant heating apparatus comprising a plurality of radiant heaters each including a housing having an open mouth, a burner face fitted in said open mouth of said housing, said housing and said face defining a plenum for containing and supplying a combustion gas to said face for passage therethrough to burn on the outwardly-facing surface thereof, and a pair of mounting legs extending from said housing in opposed facing relation to one another, one said mounting leg including a generally C-shaped engagement portion and the other said mounting leg incuding a resilient generally L-shaped engagement portion having detent means formed at the free end thereof; and a support structure having a pair of longitudinal mounting rails extending in generally parallel spaced relation to one another, each said rail having a retaining edge portion; each said heater being releasably mounted on said support structure with said one leg engaged about one said rail to receive said one rail within said C-shaped engagement portion to hookingly engage said retaining edge portion of said one rail and with said other leg resiliently engaging the other said rail with said detent means engaging said retaining edge portion of said other rail by a resilient snap fit therewith; whereby each said heater may be readily removed from and reinstalled or replaced on said support structure rapidly and without the use of tools or fasteners.

* * * * *

UNITED STATES PATENT OFFICE

CERTIFICATE OF CORRECTION

Patent No. 4,628,900 Dated December 16, 1986

Inventor(s) H. Chandler Arndt

It is certified that error appears in the above-identified patent and that said Letters Patent are hereby corrected as shown below:

Col. 3, Lines 31-32, delete "member" and insert therefor — members — .

Col. 3, Line 37, delete "place" and insert therefor — plate — .

Col. 3, Line 65, delete "snag-type" and insert therefor — snap-type — .

Col. 5, Line 14, between "under" and "effect" insert — the — .

Col. 6, Line 3, delete "support a" and insert therefor — a support — .

Col. 6, Line 22, between "receive" and "one" insert — said — .

Signed and Sealed this

Fifth Day of January, 1988

*Attest:*

DONALD J. QUIGG

*Attesting Officer* *Commissioner of Patents and Trademarks*